US005781951A

United States Patent [19]

Sergio et al.

[11] Patent Number: 5,781,951

[45] Date of Patent: Jul. 21, 1998

[54] METHOD FOR APPLYING GLUE TO A SURFACE OF PIECES OF FOOTWEAR AND DEVICE THAT CARRIES OUT THIS METHOD

[75] Inventors: Talamonti Sergio; Talamonti Federico, both of S.Elpidio a Mare, Italy

[73] Assignee: F.LLI Talamonti Macchine S.n.c., S. Elpidio a Mare, Italy

[21] Appl. No.: 653,947

[22] Filed: May 22, 1996

[51] Int. Cl.[6] ..... A43D 11/00

[52] U.S. Cl. ..... 12/142 F; 12/1 A

[58] Field of Search ..... 12/1 A, 1 W, 17 R, 12/17.2, 18.1, 142 F, 142 RS, 146 B, 146 BR

[56] References Cited

FOREIGN PATENT DOCUMENTS 0 512 526 11/1992 European Pat. Off. .
0 512 773 11/1992 European Pat. Off. .
0 588 054 3/1994 European Pat. Off. .
2 610 800 8/1988 France .
2 237 412 5/1991 United Kingdom .
2 260 257 4/1993 United Kingdom .

*Primary Examiner*—Ted Kavanaugh
*Attorney, Agent, or Firm*—McAulay Fisher Nissen Goldberg & Kiel, LLP

[57] ABSTRACT

A method for applying glue to the upper surface of soles for footwear includes the steps of transferring a sole to a first station with the upper surface turned upward, picking up the outline of the sole, transferring the sole from the first station to a second station, keeping the sole orientation unvaried and applying a jet of glue directed to the upper surface of the sole along a path that can be adjusted and that follows the border of the sole. In a different embodiment, glue is also applied to the surface of the upper that is intended for attaching of the sole.

7 Claims, 7 Drawing Sheets

FIG. 9
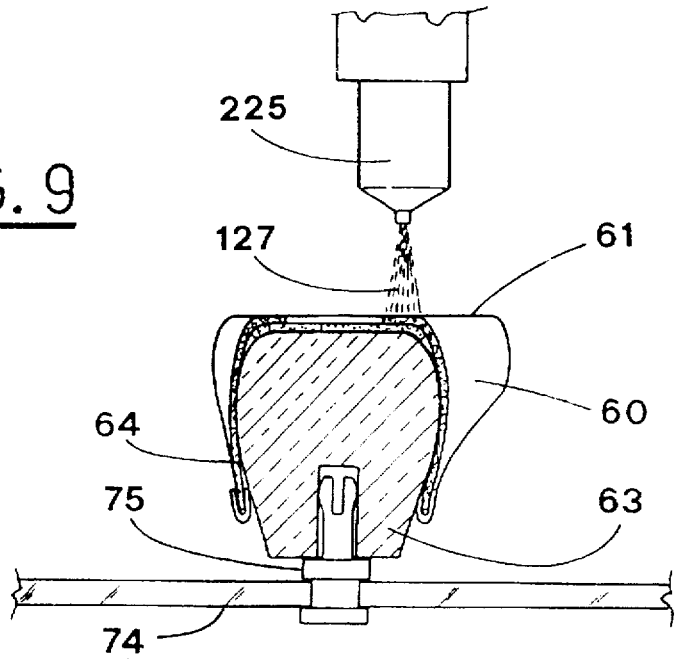
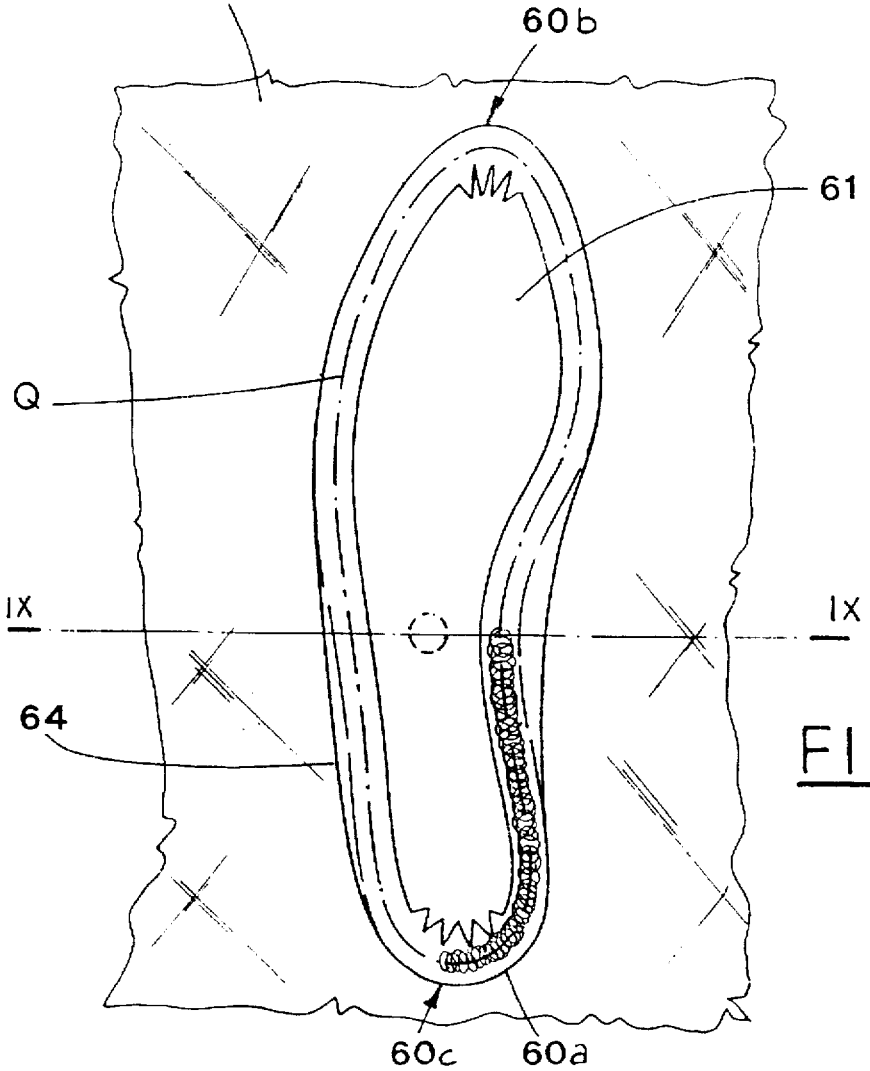
FIG. 8

METHOD FOR APPLYING GLUE TO A SURFACE OF PIECES OF FOOTWEAR AND DEVICE THAT CARRIES OUT THIS METHOD

BACKGROUND OF THE INVENTION

The present invention relates to manufacturing of footwear, in particular footwear in which glue, sometimes integrated with suitable seams, is used in order to fix the sole to the upper.

DESCRIPTION OF THE PRIOR ART

At present, the glue is applied to the upper manually (a procedure that is obsolete because of the high cost of manpower) or automatically, that does not cause particular problems, since the part of upper to which glue is to be applied, is quite regular, without indentations or recesses.

As far as sole is concerned, in some manufacturing processes, glue is not applied to the surface to be attached to the upper.

In other manufacturing processes, glue is manually applied to this surface, more precisely, along a closed loop path close to the border of the sole, so as to match the corresponding portion of the upper.

This way of proceeding has been often used up till now, in spite of high expense due to manpower cost, and health risk for the operators due to previous treatment of the surface to be glued with a halogenated substance.

Some manufacturers have tried to automatically apply glue to the sole, using a brush that touches the upper surface of the sole; the relative motion between the sole and the brush makes this latter follow a closed loop path.

It is known that the upper surface of the sole features lightening recesses and/or stiffening ridges.

It is also known that it is difficult to grip, clamp, and handle the sole because of its flexibility and particular shape; e.g. sucking cups cannot be used due to the sole irregularities, and possible mechanical gripping and clamping means would bend the sole changing its space position.

Consequently, the means used to apply the glue (i.e. the brush) touches one or more of the lightening recesses, or strikes one or more of the stiffening ridges; in both cases drops of glue can remain in the recess or on the ridge, thus causing all the problems well known to the field experts.

As it has already been mentioned, the surface of the sole on which the glue is to be applied, is previously treated with a halogenated substance.

This is performed by a suitable apparatus, at the outlet of which the soles are stored or directed, by known means, to a room, where the glue is applied in the previously described way.

This procedure needs long processing time and special operative rooms, and consequently the production cost of the footwear is negatively affected.

SUMMARY OF THE INVENTION

The object of the present invention is to propose a method for applying glue along a path with adjustable trajectory, that extends in a closed loop on the upper surface of the sole, close to the border thereof, the whole procedure being carried out without any contact between the sole and the means used for applying the glue.

Another object of the invention is to propose a method according to which the above mentioned operation is performed correctly no matter of the orientation of the sole.

Yet another object of the invention is to propose a method that fulfils all the aforementioned objects and furthermore, allows to apply the glue to the sole while this is freely resting on a suitable support.

A further object of the invention is to propose an apparatus to carry out the proposed method.

Yet a further object of the invention is to propose an apparatus that applies glue also to the upper for the intended sole.

The above mentioned objects are obtained in accordance with the contents of the claims.

BRIEF DESCRIPTION OF THE DRAWINGS

The characteristic features of the present invention are pointed out in the following with reference to the accompanying drawings, in which:

FIGS. 8 and 9 correspond to FIGS. 4 and 5, but they refer to an upper instead of a sole.

DESCRIPTION OF THE PREFERRED EMBODIMENT

Figure 1:
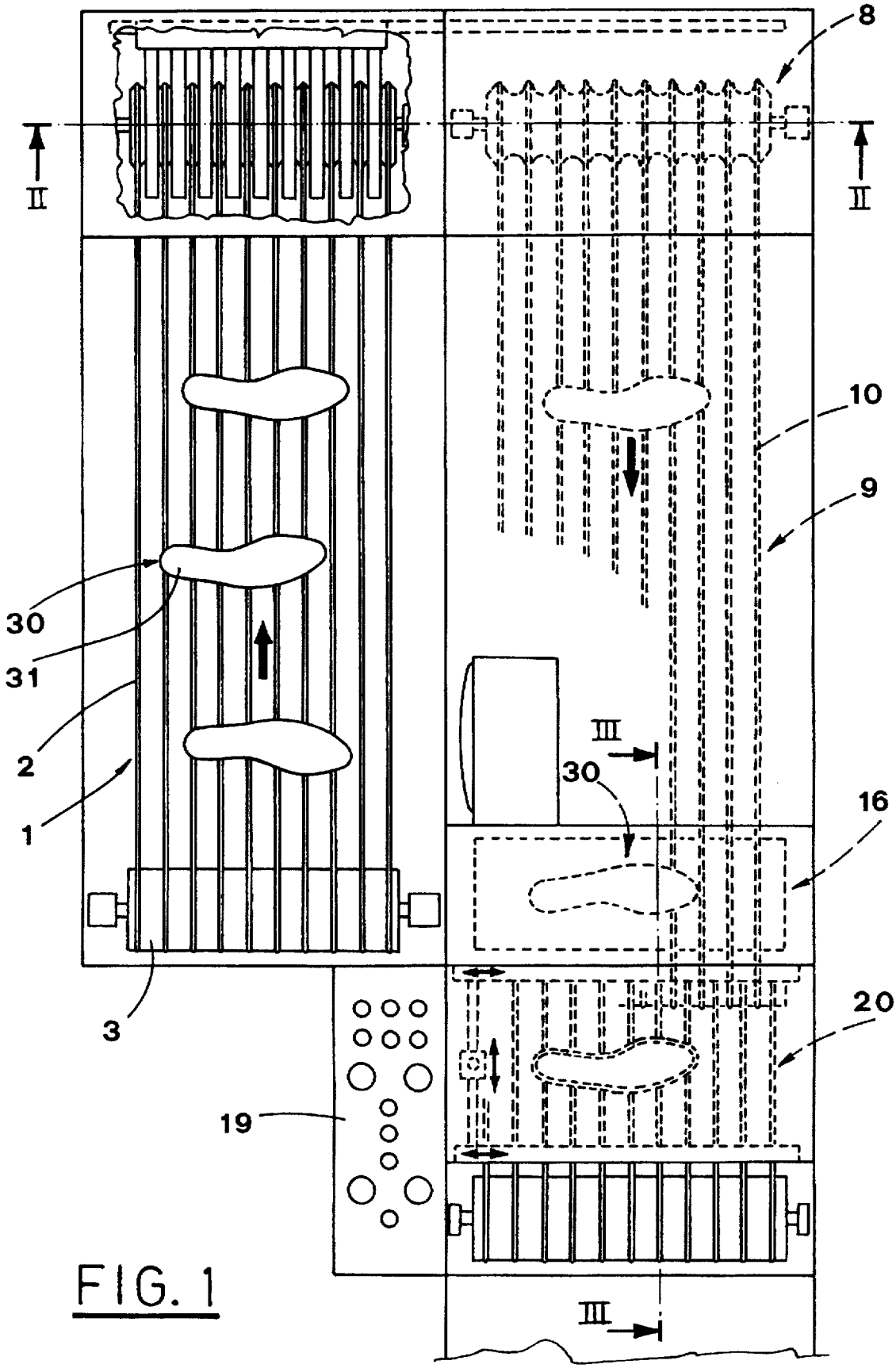
FIG. 1 shows a schematic plan view of the apparatus comprising a device carrying out the method being the subject of the present invention.

With reference to the above Figures, reference numeral 1 indicates a first conveyor including a series of wires 2 set side by side and trained around respective rollers, namely a fore roller 3 and a rear roller 4, so as to form a closed loop.

The rollers 3, 4, one of which is driven in a known way by means which are not illustrated, feature suitable raceways, not shown in detail, aimed at receiving the wires.

Figure 2A:
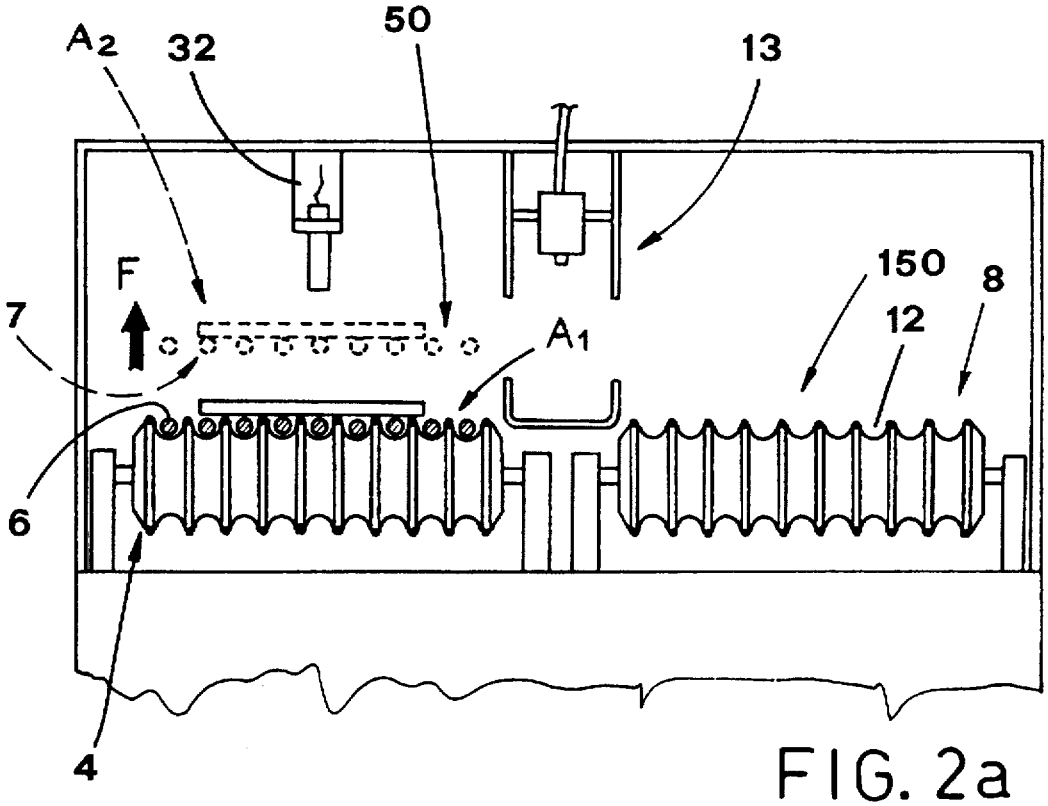
FIGS. 2*a*, 2*b* show a sectional view taken along the line II—II of the apparatus in two different operating states.

Between the raceways of the rear roller 4 there are made grooves 5 (FIGS. 2*a*, 2*b*) aimed at receiving respective prongs 6 of a comb-like lift-conveyor 7 located in a lowered position.

There is also a second conveyor 9, similar to the conveyor 1. The rear roller 8 of the second conveyor and the roller 4 of the first one, are coaxial.

Also the second conveyor 9 includes wires 10 (which are transparent for the reasons explained hereinafter) and a fore roller 11; grooves made in the said rear roller 8 are indicated with 12.

The lift-conveyor 7 is moved by known means, not illustrated, between adjacent stations 50, 100, 150, with the intermediate station 100 centred with respect to the rear roller 4 and the rear roller 8.

In each extreme station 50, 150, the lift-conveyor is moved between a lowered position $A_1$, in which the prongs 6 enter the grooves 5, 12 of the rollers 4, 8, and a raised position $A_2$ that is kept while passing through and dwelling in the intermediate station 100.

A device 13 for treating the soles with halogenated substance, is situated in the intermediate station 100, over the lift-conveyor 7.

A transparent supporting plate 16a is situated at the top of a box-like element 16 that is positioned under the end of the upper run 9a of the conveyor 9.

A light source, that is not shown, is placed inside the box-like element 16, and the light beam coming from the plate 16a is not weakened or troubled by the overlying wires 10, which are made, as already mentioned, of material transparent to the light radiation emitted by the source.

A video camera 17, connected with a monitor 18, is situated over the box-like element 16 and the upper run 9a of the conveyor 9. Signals issued by the camera 17 are sent to a processing unit that works according to a programme and that is interlocked with a control panel 19 (FIG. 1).

The camera 17, the box-like element 16 and the portion of the upper run 9a situated therebetween, form a pick up station $S_1$, or first station.

Right after the second conveyor 9, there is a third conveyor 20, also including wires as the other ones, and the rear roller of the third conveyor is also the fore roller 11 of the conveyor 9.

Figure 5:
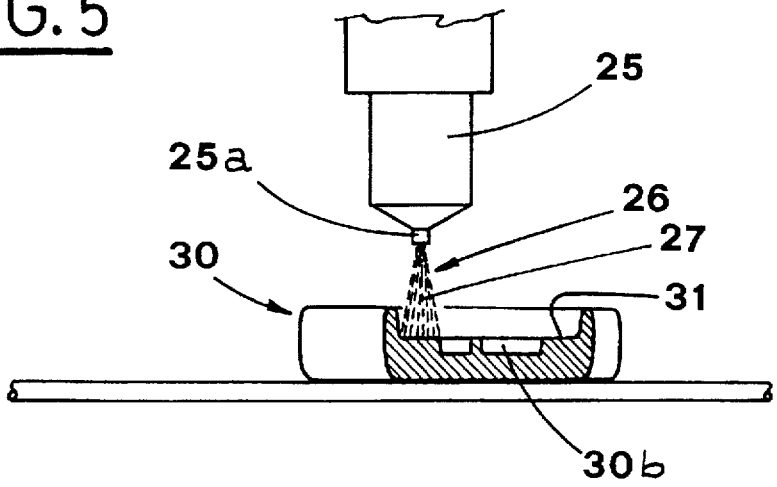
FIG. 5 shows a sectional view taken along the line V—V of FIG. 4.

Over the upper run 20a of the conveyor 20, there is a spray gun 25 designed to eject a jet 26 of a suitable glue 27 (FIG. 5).

The gun 25 is carried by a longitudinal bar 28, that is moved transversally by known means, not shown, controlled by the processing unit.

The spray gun is moved along the bar by other known means, not shown, also controlled by the same processing unit, which furthermore activates and deactivates the spray gun.

Consequently, the nozzle 25a of the gun 25 is brought in a horizontal plane along a linear path of any kind, in particular in a closed loop.

The upper run 20a of the conveyor 20 and the room occupied by the gun 25, form a second station $S_2$, or glue applying station.

Figure 3:
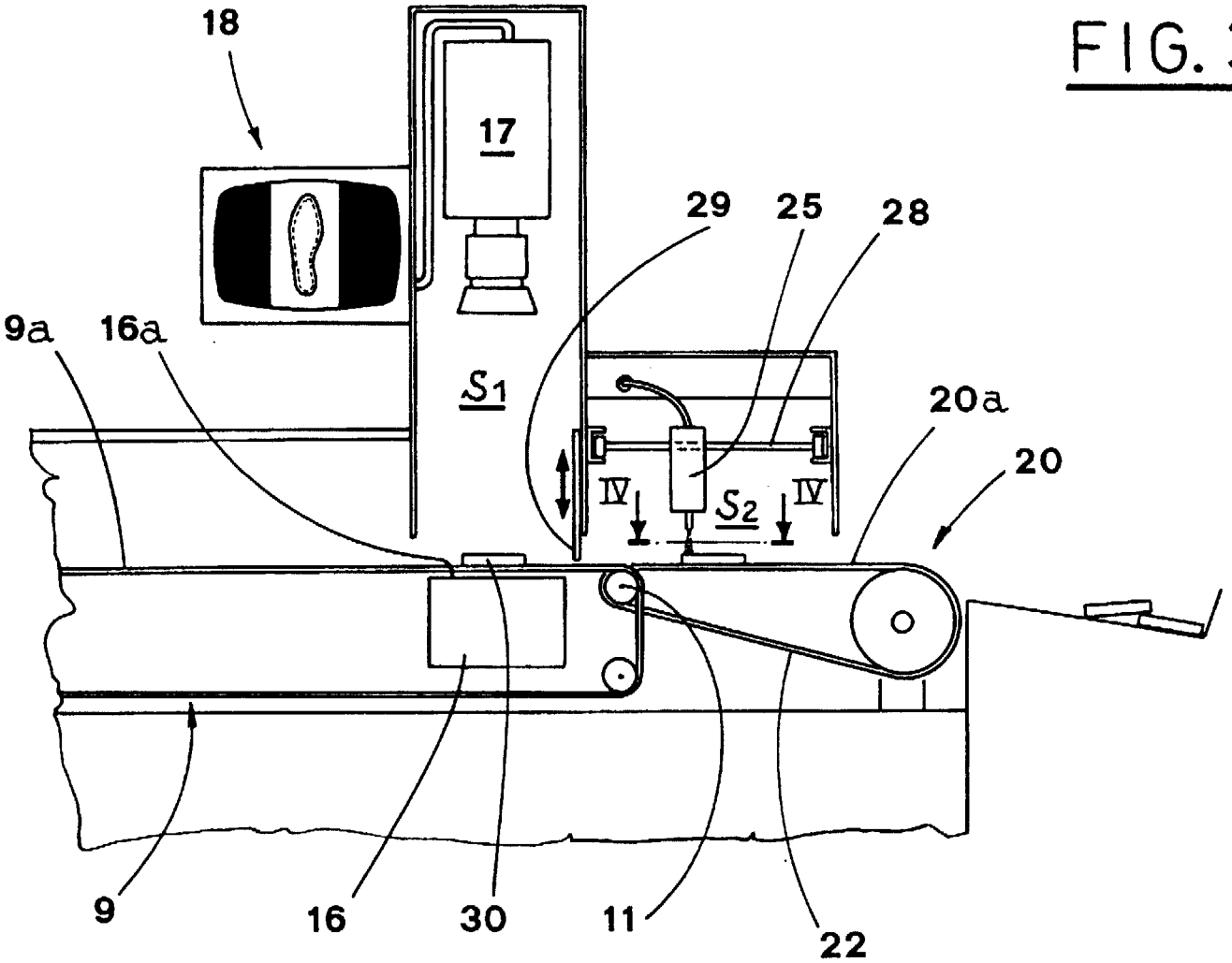
FIG. 3, shows a sectional view taken along the line III—III of the FIG. 1.

Between the above mentioned stations, there is a shutter 29, that moves vertically (FIG. 3) between a raised position, in which the soles pass freely from the first to the second station, and a lowered position, in which the first station is protected against possible glue spreading from the second station.

The operation of the above described apparatus will be explained in detail in the following, with particular reference to the means that carry out the proposed method.

The soles 30 are placed, in any orientation, on the first conveyor 1 with the upper surface 31, that is the surfaces that is intended for attaching to the sole, turned upward.

In the extreme station 50, the lift-conveyor 7 is in the lowered position $A_1$. When a sensor 32 detects a sole 30 that has reached a position thereunder, the conveyor 1 is stopped and the lift-conveyor 7 is activated (see FIGS. 2a, 2b).

The lift-conveyor raises (in the direction F) from the lowered position $A_1$ to the raised position $A_2$, with the sole 30 carried by the prongs 6 (FIG. 2).

Figure 2B:
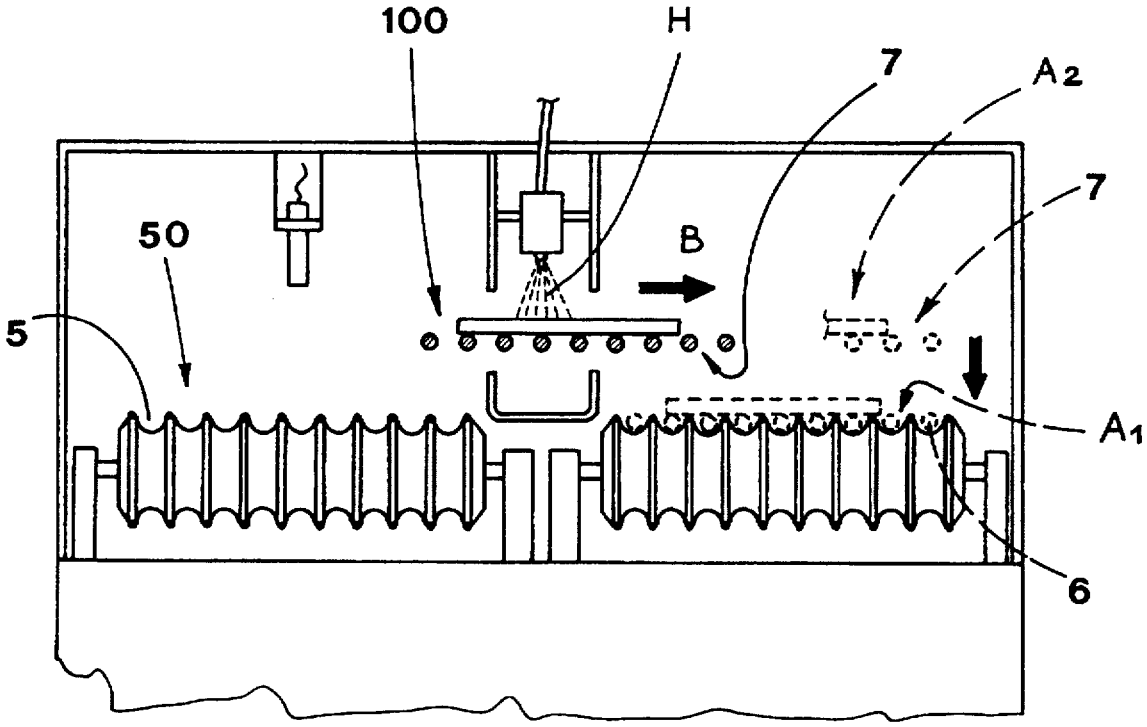

At this moment, the lift-conveyor 7, while keeping in the raised position, translates (in the direction B) toward the other extreme station 150, passing through the station 100, where the upper surface 31 of the sole 30 undergoes a treatment by a jet H of known halogenated substances (FIG. 2b).

In the extreme station 150, the lift-conveyor is lowered until the prongs 6 are inserted in the grooves 12 of the roller 8, thus allowing the second conveyor 9 to bring the sole 30, already treated with halogenated substances, toward the first station $S_1$.

Obviously, the lift-conveyor 7 is raised, translated and lowered in order to take over a subsequent sole from the conveyor 1.

The upper run 9a of the second conveyor 9 is long enough so as to allow the solvents, used during the treatment with the halogenated substances, to evaporate completely, before reaching the station $S_1$.

When the sole 30 is in the station $S_1$, the conveyor 9 is stopped, thus permitting to perfectly pick up the outline 30a of the sole 30 by means of the camera 17. Also the orientation of the sole 30 with respect to the horizontal plane defined by the upper run 9a of the conveyor 9 is detected. The image picked up is shown on the monitor 18.

The electric signals obtained by the image picked up are transmitted to the processing unit.

The two conveyors 9, 20 are operated after the raising of the shutter 29, and the sole 30 is transferred to the second station $S_2$, in which it remains for a predetermined time.

It is to be pointed out that the sole remains in the same orientation, i.e. the orientation of the sole in the station $S_2$ is the same as in the station $S_1$.

In the station $S_2$ the gun 25 and the means provided to control it in two orthogonal directions, are activated, while the shutter 29 lowers in order to protect the station $S_1$ from spreading of glue.

The nozzle 25a of the gun is made to move, in a horizontal plane, along a closed loop path, that is calculated for each sole and that follows the outline 30a of that sole.

It is to be pointed out, that the jet 26 is preferably centred with respect to the axis of the nozzle 25a, and this allows to direct precisely the jet close to the border of the sole so as to define a path P that usually is like a closed loop.

Figure 4:
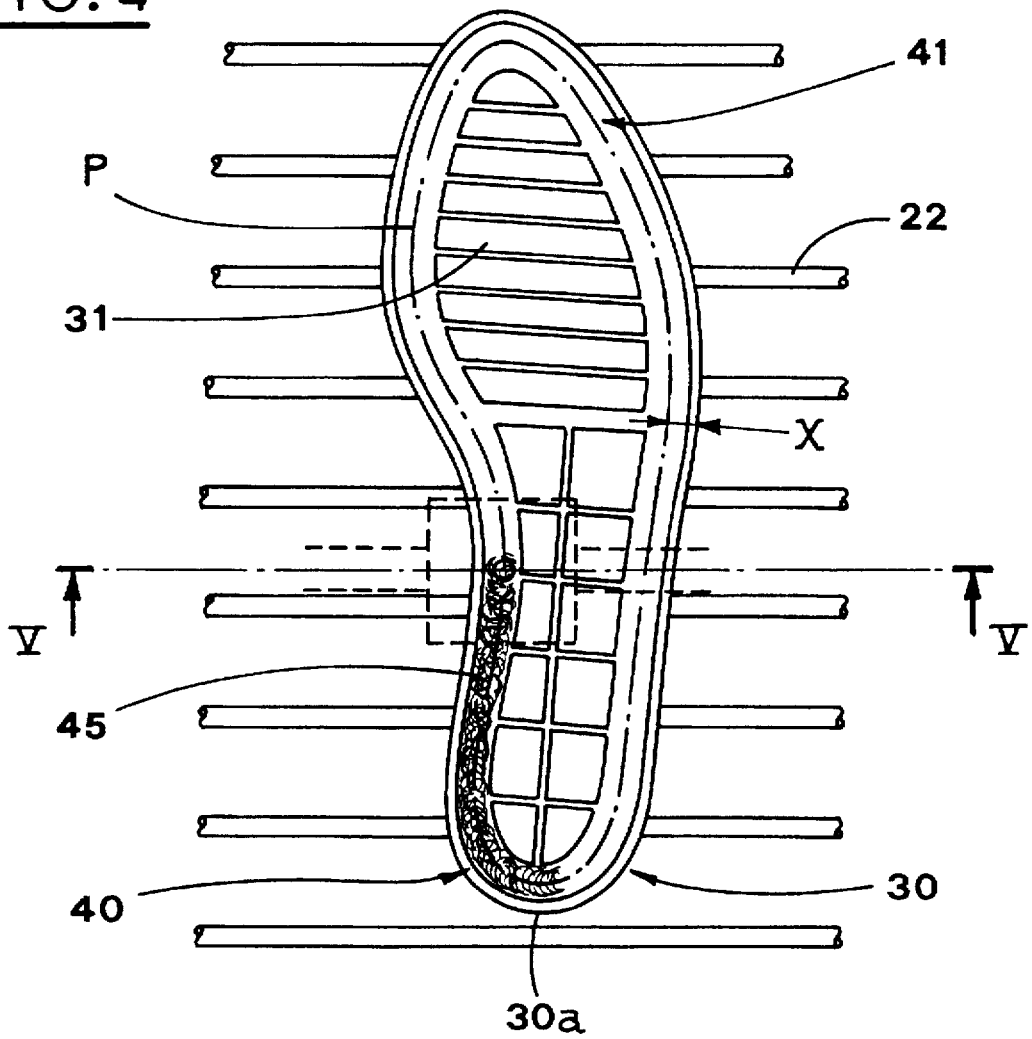
FIG. 4 shows an enlarged sectional view taken along the line IV—IV of FIG. 3.

The operation can be better understood with reference to FIG. 4, where a portion 40 of the glue strip 45 is illustrated, while the part not glued yet is indicated with 41 (sketched line).

The distance X between the strip 45 and the outline 30a of the sole is calculated by a predetermined programme, but its length must prevent recesses 30b (FIG. 5) or stiffening ridges, made on the surface 31, from being touched by the jet 26; this distance can be kept constant or varied according to the sole shape.

The path P is like a closed loop but it can also be open or criss-crossed.

The above described method has many advantages, among which the following:

the soles are simply placed, oriented in any way, on suitable supports, in particular the wires of conveyors 9, 20;

glue is applied without any contact between the surface 31 of the sole and the glue ejecting means (i.e. gun 25);

the strip 45 of glue applied to the surface 31 extends along an adjustable path that is kept at a distance X from the outline 30a of the sole, which distance can be programmed, calculated and varied.

It is to be pointed out that the above mentioned advantages are obtained independently from the shape and structure of the sole, as well as from orientation of the sole in the first station $S_1$.

The characteristic of the proposed method requires a very simple device 200 to be carried out, formed by the stations $S_1$ and $S_2$, first and second and by means connected with the latter.

In fact, there are not means for clamping and/or gripping and/or positioning the sole, since it is supported on the wires 10 of the conveyor 9 (station $S_1$) that cooperate, between the stations $S_1$ and $S_2$, with the wires 22 of the conveyor 20, aimed at supporting the sole in the station $S_2$.

These conveyors 9, 20 cooperate, in the stations $S_1$, $S_2$, with the camera 17, with the associated box-like element 16, and with the gun 25 controlled by means that drive it along two orthogonal directions, the whole being interlocked with the processing unit.

With reference to the accompanying figures, the conveyor 9 is fed with the soles coming from a station where they have been treated with halogenated substances, (that is the central station 100).

This should not be considered as a limitation, since the conveyor 9 can be supplied in any way, e.g. with soles coming from a special store.

The particular combination of the device 200 with the stations 50, 100, 150, and consequently with the means associated thereto, i.e. the lift-conveyor 7 and the conveyor 1, allows to provide a compact, versatile and functional apparatus that permits to treat the soles with halogenated substances and then, to apply glue thereto.

A further advantage, besides the ones already mentioned, results from the fact that the conveyor 1 is fed with soles in any orientation, but with the upper surface turned upwards.

The main advantage of the proposed method is that the glue is applied along a predetermined path P close to the outline 30*a* of the sole, without any contact between the gun and the surface 31.

In a possible different embodiment of the present invention, instead of the conveyors 9, 20, there are trailer means equipped with means for gripping, and/or clamping and/or orientating the sole (such as clamps, suckers, box-like holders) aimed at positioning the sole in the stations $S_1$, $S_2$.

If the soles are equal to one another, and held by trailing means that keep the same orientation for all the soles, the camera 17 is no longer necessary, since the outline and the orientation of the sole are previously stored considering a predetermined tolerance.

The above description provides breaks in the movement of the sole form station $S_1$ to station $S_2$; it is obvious that such breaks may be avoided.

Figure 6:
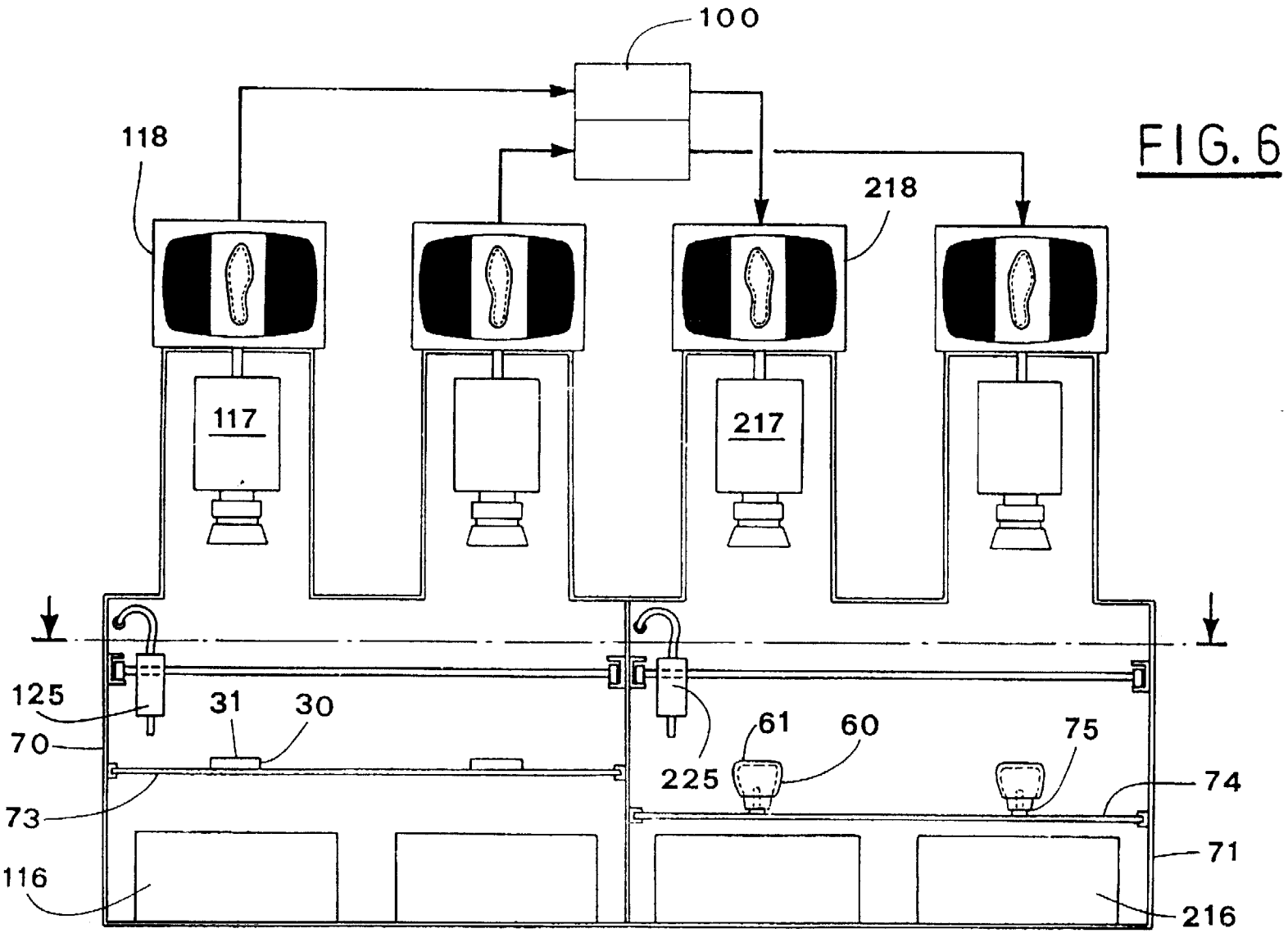
FIG. 6 shows a different embodiment of the device that carries out the present invention.
Figure 7:
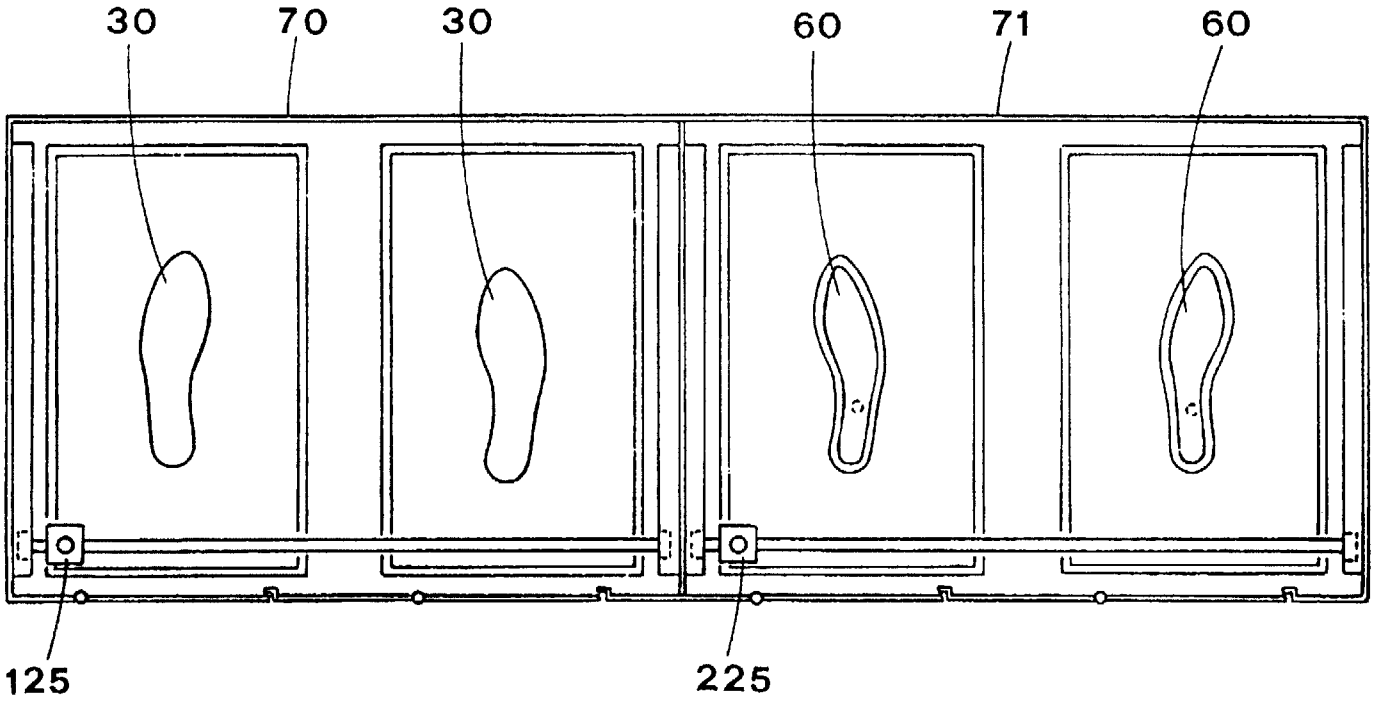
FIG. 7 shows a plan view of the device shown in FIG. 6.

According to a different embodiment of the invention, carried out by the device shown in FIGS. 6 and 7, glue is also applied to the bottom 61 of the upper 60, in the same time, using the same method.

However, while the sole 30 is a flat piece that can be easily placed on a support plane, the upper 60 is made of soft material, and therefore it must be set on a last 63, so as to have it well taut and easy to be supported.

When the upper is set on the last, the outline 60*a* of the bottom cannot be picked up by means of a light beam directed upwards and a camera, because the lateral curvature 64 of the last, necessary to fit the shape of the upper, would be detected in certain zones, instead of the bottom outline. In fact, only the fore part 60*b* and the rear part 60*c* of the upper bottom profile are correctly picked up.

Furthermore, the upper 60 mounted on the last 63 is rather higher than the sole 30.

All the problems have been solved by providing at least two cabinets 70, 71 arranged side by side, in the first of which the outline 30*a* of the sole 30 is picked up and then glue is applied thereto, while in the second cabinet 71 glue is applied to the upper bottom 61 on the basis of the outline picked up from the sole.

Obviously, the sole and the upper must be coupled, that is the upper must be the one that is to be adhered to that sole.

In the first cabinet 70 two soles are treated while in the second one two uppers 60 undergo operation. Each sole 30 of the first cabinet is coupled with a respective upper of the second cabinet.

The soles are placed, either manually or automatically, in the first cabinet 70, on a supporting light-transparent surface 73.

Each sole is positioned so as to be located under one of two video cameras 117, which pick up the outlines of the respective soles as previously described.

Two monitors 118 are connected to the cameras 117, respectively.

Two light sources, not shown, are arranged inside two respective box-like elements 116 situated under the supporting surface 73, so as to emit a beam of light, upwardly directed, for each sole.

When the outline 30*a* of the soles 30 is picked up, the spraying device 125 of the soles cabinet 70 is activated so as to spray glue along the border of both the soles, in the way previously described.

In the same time, the soles profile images are transferred to a processing unit 100, to be processed as described in the following.

In the second cabinet 71, the two uppers 60 are arranged basically like the sole 30, but turned upside down.

The uppers 60 are mounted on respective lasts 63 which are removably fixed to a transparent supporting surface 74, e.g. by means of press fit couplings 75.

Consequently, the bottom profile of each upper results reversed, in the transverse dimension, with respect to the respective sole outline. Also in the second cabinet there are two video cameras 217, each one directed toward a respective upper.

The supporting surface 74 of the second cabinet 71 is set out at a level lower that the level of the supporting surface 73 of the first cabinet 70 for the soles. The difference in level can be adjusted to match the difference in height between the soles and the uppers mounted on the lasts. This differences in thus compensated.

The cameras 217 of the second cabinet 71 pick up the outlines of the two uppers 60, with the help of two light sources 216 situated thereunder, and define the orientation assumed by each upper in the horizontal plane.

Obviously, the uppers could be set out always in the same exact position, since the lasts are fixed to stationary points of the supporting plane, and accordingly the cameras could be omitted in the second cabinet, because the orientation of the uppers would be unvaried.

In the example described herein, also two monitors 218 are provided and connected to the cameras 217 of the second cabinet 71, although they are not strictly necessary.

The processing unit 100 reverses the electronic outline image of each sole 30, with respect to the transverse dimension only, thus obtaining a specular image that corresponds to the actual outline of the respective upper 60.

The same electronic outline image is rotated and translated in the horizontal plane to make the rear and fore parts of it to match the fore and rear parts 60*a*,60*b* of the respective upper image.

All these operations are performed in a very short time by the electronic processing unit 100.

Finally, the spray gun 225 of the second cabinet is activated and a jet of glue 127 is sprayed on the bottom 61 of each upper 60 along a path Q that follows the outline 60*a*.

The path Q is not altered by a wrong image of the upper profile due to the shape of the last 63, because it is obtained from the reversed outline of the corresponding sole 30.

In the example described herein, two soles 30 and two uppers 60 can be disposed in the cabinets 70,71, but it is obvious that smaller cabinets will allow to treat only one sole and one upper at a time, whereas bigger cabinets will allow to treat three or more soles and uppers at the same time.

Moreover, in the described example, two cameras are used in each cabinet, but only one camera could be provided for each cabinet, when a suitable programme is installed in the electronic processing unit.

Finally, there is only one spray gun in each cabinet, but in order to expedite the process, two or more spray guns could be mounted in each cabinet, each one driven by respective means, according to the number of sole and uppers being treated.

What is claimed is:

1. A method for applying glue to a surface of a piece of footwear, comprising the steps of:

freely resting a sole with any orientation on an upper run of a conveyor, an upper surface of the sole turned upwards;

moving the sole to a first station;

determining an outline of the sole, and creating a signal which corresponds to the outline of the sole and sending the signal to a processing unit, for determining a path extending close to the outline of the sole; and, applying a strip of glue along the path on the upper surface of the sole, by sending a jet of glue which is moved in accordance with the path determined from the outline of the sole.

2. The method according to claim 1, wherein the outline is determined in the first station, and further comprising transferring the sole to a second station where the strip of glue is applied, the transferring between the first and second stations being performed while maintaining the same orientation of the sole.

3. The method according to claim 2, further comprising stopping the sole in the second station for a predetermined time.

4. The method according to claim 1, further comprising positioning an upper on a second supporting means, the upper mounted on a last and having a bottom turned upward, and applying a strip of glue to the bottom of the upper using a second jet of glue directed to the upper along a second path extending close to an outline of the upper, determining the second path using a reverse outline image of the sole outline previously determined.

5. The method according to claim 4, further comprising determining the outline of the bottom of the upper and locating a fore part in a horizontal plane and a rear part of the bottom, rotating and translating the reverse outline image of the sole so that the fore and rear parts of the sole match the fore and rear parts of the upper.

6. The method according to claim 1, wherein the path is closed to form a loop.

7. The method according to claim 2, wherein the path is closed to form a loop.

* * * * *